United States Patent [19]

Kallmes

[11] Patent Number: 4,687,549

[45] Date of Patent: Aug. 18, 1987

[54] HYDROFOIL BLADE

[75] Inventor: Otto J. Kallmes, Danvers, Mass.

[73] Assignee: M/K Systems, Inc., Danvers, Mass.

[21] Appl. No.: 947,883

[22] Filed: Dec. 30, 1986

Related U.S. Application Data

[63] Continuation-in-part of Ser. No. 817,034, Jan. 8, 1986, abandoned.

[51] Int. Cl.[4] ..... D21F 1/48; D21F 1/54

[52] U.S. Cl. ..... 162/352; 162/374

[58] Field of Search ..... 162/352, 374, 354

[56] References Cited

U.S. PATENT DOCUMENTS

| | | | |
|---|---|---|---|
| 1,781,928 | 11/1930 | Liebeck | 162/351 |
| 2,928,465 | 3/1960 | Wrist | 162/352 |
| 2,928,466 | 3/1960 | Burkhard et al. | 162/354 |
| 3,201,308 | 8/1965 | Goddard et al. | 162/352 |
| 3,220,920 | 11/1965 | Truxa | 162/352 |
| 3,497,420 | 2/1970 | Clark | 162/352 |
| 3,619,363 | 11/1971 | Pherson | 162/352 |
| 3,874,998 | 4/1975 | Johnson | 162/352 |
| 3,922,190 | 11/1975 | Cowan | 162/352 |
| 4,088,531 | 5/1978 | Lamminen | 162/352 |
| 4,123,322 | 10/1978 | Hoult | 162/352 |
| 4,140,573 | 2/1979 | Johnson | 162/352 |

FOREIGN PATENT DOCUMENTS

| | | | |
|---|---|---|---|
| 111795 | 6/1964 | Czechoslovakia . | |
| 2108489 | 9/1971 | Fed. Rep. of Germany . | |
| 457764 | 2/1975 | U.S.S.R. | 162/352 |
| 461195 | 3/1975 | U.S.S.R. | 162/352 |
| 848522 | 4/1979 | U.S.S.R. . | |

OTHER PUBLICATIONS

"Drainage at a Table Roll"-G. I. Taylor, Pulp & Paper Mag of Canada Convention Issue 1956, pp. 267-276.

"Drainage at a Table Roll and a Foil"-G. I. Taylor and First Discussion Session-Second Symposium on Hydrodynamics of the Fourdrinier Wet End-CPPA-TS, 44, 1958, pp. 284-292.

"New Hvyflo Blades Reduce Drag-Load (Like the Computer Said They Would)", 1972.

*Primary Examiner*—S. Leon Bashore

*Assistant Examiner*—K. M. Hastings

*Attorney, Agent, or Firm*—Witherspoon & Hargest

[57] ABSTRACT

A hydrofoil blade and support for use in a paper making machine, and a method using a hydrofoil blade for dewatering and forming a paper web on a paper machine forming medium wherein a single phase fluid is formed in a gap between the hydrofoil blade and forming medium, and the gap is extended a sufficient distance in the machine direction to prevent expansion and corresponding cavitation of the single phase fluid in the gap.

12 Claims, 6 Drawing Figures

HYDROFOIL BLADE

This is a continuation-in-part of copending Ser. No. 817,034 filed on Jan. 8, 1986, now abandoned.

BACKGROUND OF THE INVENTION

1. Field of the Invention

This invention relates to a hydrofoil support or box for use in a paper making machine of the type wherein hydrofoil blades are positioned beneath a forming medium and extended in the cross machine direction relative to the forming medium for draining water through the forming medium from a paper web being formed on the forming medium and for forming the paper web. This invention also relates to a hydrofoil blade and to a method using hydrofoil blades for dewatering and forming a paper web.

2. Description of the Prior Art

In the typical Foundrinier papermaking machine, an aqueous suspension of fibers, called the "stock" is flowed from a headbox onto a traveling Fourdrinier wire or medium, generally a woven belt of wire and/or synthetic material, to form a continuous sheet of paper or paper-like material. In this connection, the expression "paper or paper-like material"is used in a broad or generic sense and is intended to include such items as paper, kraft, board, pulp sheets and non-woven sheet-like structures. As the stock travels along on the Fourdrinier wire, formation of a paper web occurs, as much of the water content of the stock is removed by draining. Water removal is enhanced by the use of such well-known devices as hydrofoil blades, table rolls and/or suction devices. This invention relates to hydrofoil blades.

The hydrofoil blades used in papermaking perform two functions. The first function is to create a vacuum pulse over the downward inclined face of the hydrofoil blade. This pulse removes a portion of the white water from the lower side of the stock or three-dimensional fiber suspension which lays upon the forming medium and causes some of the fibers to be laid down and formed into a web. The amount of such water removal and web formation over a given hydrofoil blade is small, and therefore a considerable number of blades is required to form all of the fibers in a stock suspension into a two dimensional web. For example, the use of ten to fifty hydrofoil blades is not uncommon. In other words, the sheet forming process is a step-by-step filtration process as the forming medium travels over the hydrofoil blades, with some of the fibers in the lower portion of the suspension over the partially-formed web being added to the web at each successive foil blade. The average net change in fiber concentration or consistency of this process ranges from the headbox consistency, which is usually about 0.4% to about 1%, up to about 2.5%.

The second function of a hydrofoil blade is to maintain the fibers which are still in suspension throughout the forming process in an as-well-as dispersed condition as possible; i.e., in a deflocculated condition. This function is extremely important as fibers in the 0.5–2.5% consistency range have a strong tendency to flocculate into clumps on their own in a matter of milliseconds once the fiber dispersive forces have decayed. This flocculation causes the final paper to be highly non-uniform or flocculated in appearance.

The fiber dispersive function of hydrofoil blades is caused primarily by the decay of the dewatering vacuum pulse which imparts a momentary upward force or pulse into the stock. This pulse creates random small scale flows, i.e., turbulence, in the stock above the partially-formed web. The greater the angle of the downward inclined part of the hydrofoil blade, the greater this deflocculating pulse or turbulence. The speed of travel of the suspension over the blade is also a factor in determining the intensity of this pulse. Thus, at high machine speeds, the size of the hydrofoil blade angle which can be used is limited lest the vacuum be so large that the pulse created will throw some of the stock upward into the air. This phenomenon known as "stock jump" can readily damage the uniformity of the sheet.

One aspect of hydrofoil blade dewatering overlooked in the past is that when the vacuum pulse created by the inclined angle of the hydrofoil blade decays back to atmospheric pressure, the decay is somewhat of an unstable phenomenon. This is because the hydrofoil blade generally discharges the water removed from the suspension directly into the atmosphere. In other words, the decay of the vacuum pulse occurs virtually instantaneously at the point where the gap between forming medium and hydrofoil blade becomes too large to support a continuous column of water. The location of this point is extremely sensitive to all of the forces and resistances affecting the dewatering process as evidenced by the highly variable amount of water removed from the suspension across the width of foil blades. This variability can be readily observed on any paper making machine. The water removed from the suspension by any one hydrofoil blade is largely carried along the underside of the forming medium to the next blade whose leading edge skives the water off the underside of the forming medium. The amount of skived water varies very considerably from point to point across the width of a machine at most hydrofoil blade positions.

The variability of dewatering in the cross machine direction of the hydrofoil blades is further exacerbuted by the slight non-uniformity of wear of the high density ultra-high molecular weight polyethylene of which most hydrofoil blades are made, as well as by the non-uniform build-up of fibrous material on the leading edge of many blades. These problems of polyethylene hydrofoil blades have led to the development of a variety of ceramic blades which are much more wear resistant. While ceramic blades hold their shape much better than polyethylene blades, they are extremely fragile, prone to damage, and relatively expensive. Since such blades are difficult to handle, once a Fourdrinier table has been laid out, papermakers are loathe to alter blades. Thus, the use of ceramic hydrofoil blades is limited.

The cross machine direction variability of dewatering of hydrofoil blades is one, if not the primary source of the non-uniformity of the "dry line", i.e., the line across the Fourdrinier where air is first introduced into the wet web over the vacuum foils or suction boxes. This variability ultimately leads to the cross-direction variation in the moisture content of the finished paper, one of the most critical problems facing the paper industry.

Another problem created by this turbulence generating pulse of hydrofoil blades is that it loosens up the structure of the partially formed web and allows for the finer fibers as well as the filler particles to be washed out of the web. Thus, the stronger the vacuum pulse of a foil blade, the lower the fines and filler retention in the lower part of the web. This top-to-bottom side variation of fines and fillers in a sheet is a major source of many paper application problems well-known to those skilled in the art.

Turning now to another aspect of hydrofoil blade applications and problems, a new forming strategy has been evolved in which it is desirable to minimize or even totally eliminate the turbulence on the Fourdrinier wire generated by the hydrofoil blades. This new approach employs formation showers which create stock ridges which periodically collapse and reform on their own down the wire. The collapse and regeneration of these ridges creates a cross machine direction shear which deflocculates fibers in much the same way as the cross machine direction shear generated by the shake of slower papermaking machines. The advantage of these ridges over shakes is that the ridges can be employed and are effective at any machine speed including relatively high ones, whereas the effective application of the shake is limited to machine speeds below 300–400 m/min. The stock ridges formed by formation showers are extremely fragile fluid structures which are easily destroyed by the turbulence generated by hydrofoil blades.

It is clear from all of the foregoing that there is a need for hydrofoil blades wherein the amount of water removed from the suspension across each blade width; that is, the dewatering in the cross machine direction, is controlled by stabilizing the vacuum decay zone of each blade. In addition, the absence of a strong pressure pulse following dewatering is desirable in order to obtain a higher and more uniform fines and filler retention. Further, there is a need in some applications for a dewatering hydrofoil blade system which does not generate turbulence.

SUMMARY OF THE INVENTION

This invention achieves these and other objects by providing a hydrofoil blade support for use in a paper making machine of the type wherein hydrofoil blades are positioned beneath a forming medium and extended in the cross machine direction relative to the forming medium for draining water through the forming medium from a paper web being formed on the forming medium and for forming the paper web. The hydrofoil blade support includes at least a first hydrofoil blade comprising a first forming medium bearing surface lying in a first plane and having a first leading edge and a first trailing surface diverging downward relative to the first forming medium bearing surface from a first crease line to a first trailing edge. The first trailing edge lies in a second plane parallel to the first plane. A water directing surface extends downward from the first trailing edge. At least a second adjacent hydrofoil blade is provided comprising a second forming medium bearing surface having a second leading edge, a front surface extending downward from the second leading edge at an acute angle relative to the second forming medium bearing surface, and a second trailing surface diverging downward relative to the second forming medium bearing surface from a second crease line to a second trailing edge. The water directing surface overlaps and is spaced from the front surface, and the first plane is spaced from the second plane in the range of about 0.05 millimeters to about 4 millimeters, to form means forming a gap between the forming medium and the adjacent hydrofoil blade, when the hydrofoil support is mounted on the paper making machine, so that during the paper making operation the water removed from the paper web by suction created by the hydrofoil blades completely fills the gap in the absence of air thereby preventing expansion and corresponding cavitation of the water in the gap.

DESCRIPTION OF THE PREFERRED EMBODIMENTS

Figure 1:
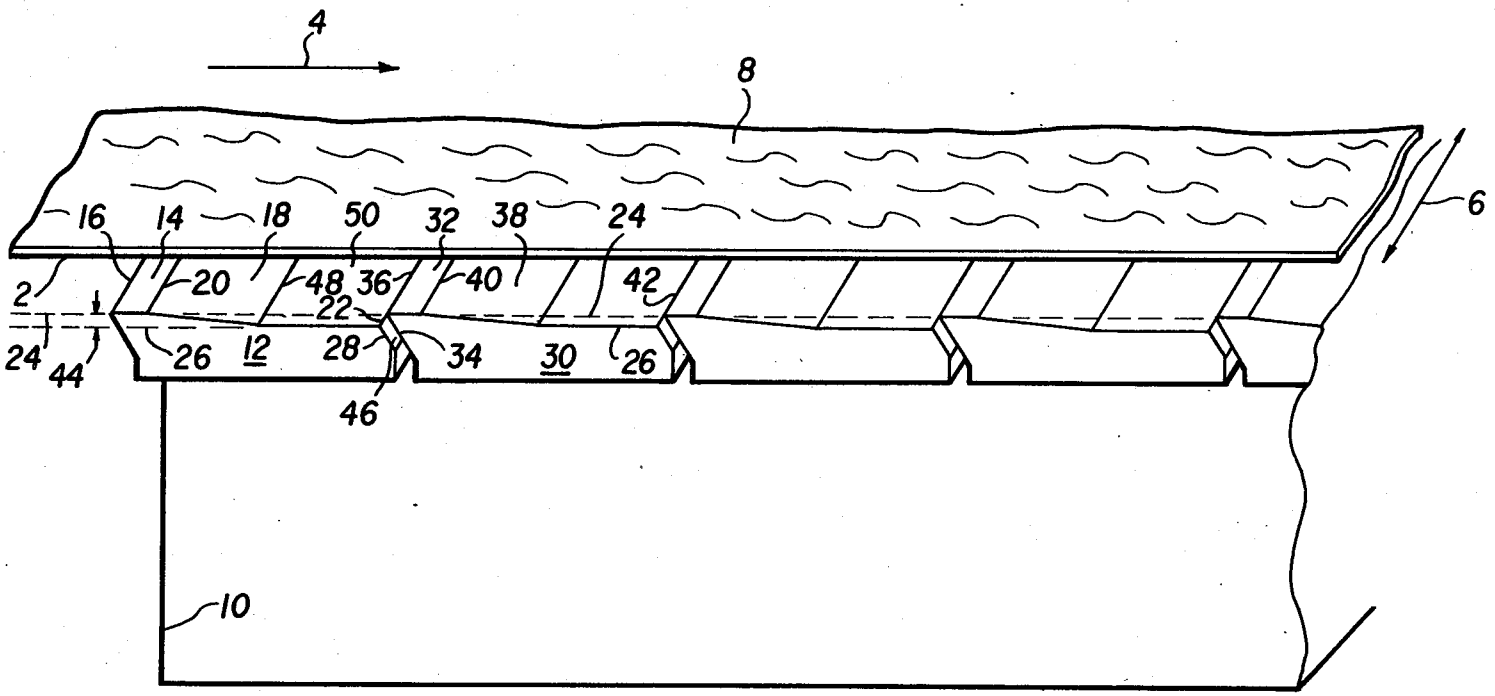
FIG. 1 is a diagramatic representation of one embodiment of the present invention.

The embodiment of this invention which is illustrated in FIG. 1 is one which is particularly suited for achieving the objects of this invention. FIG. 1 diagramatically depicts a portion of the forming section of a paper making machine of the type wherein a forming medium 2 receives stock from a headbox at a first end (not shown) and transfers a substantially self-supporting paper web from the forming medium 2 at a second end (not shown), the forming medium travelling in the machine direction generally designated by arrow 4. Hydrofoil blades are provided beneath the forming medium 2. The hydrofoil blades extend in the cross machine direction relative to the forming medium, the cross machine direction generally designated by arrow 6. The functions of hydrofoil blades are to drain water through the forming medium 2 while the paper web 8 is being formed on the forming medium and to form the paper web. In the present invention, a hydrofoil support or box 10 is provided which includes at least a first hydrofoil blade 12 comprising a first forming medium bearing surface 14 lying in a first plane and having a first leading edge 16, and a first trailing surface 18 diverging downward relative to the first forming medium bearing surface 14 from a first crease line 20 to a first trailing edge 22. The first trailing edge lies in a second plane parallel to the first plane. The first and second planes are schematically represented at 24 and 26, respectively. A water directing surface 28 extends downward from the first trailing edge 22.

A second adjacent hydrofoil blade 30 is also provided. Blade 30 comprises a second forming medium bearing surface 32 having a second leading edge 36, a front surface 34 extending downward from the leading edge at an acute angle relative to the second forming medium bearing surface, and a second trailing surface 38 diverging downward relative to the second forming medium bearing surface 32 from a second crease line 40 to a second trailing edge 42. As can be seen in FIG. 1, the water directing surface 28 overlaps and is spaced from the front surface 34. The distance 44 between the first plane 24 and the second plane 26 is in the range of about 0.05 millimeters to about 4 millimeters. Preferably, the distance between surfaces 28 and 34 is also in the range of about 0.05 millimeters to about 4 millimeters, the spacing between planes 24 and 26 and surfaces 28 and 34 preferably being similar. The interrelationship of the overlapping and spaced surfaces 28, 34 which from a channel 46 between adjacent hydrofoil blades, and the specifically dimensioned distance 44 between planes 24, 26, from means forming a gap between the forming medium 2 and the adjacent hydrofoil blades 12, 30, when the hydrofoil blade support 10 is mounted on the paper making machine, so that during the paper making operation the water removed from the paper web by suction created by the hydrofoil blade completely fills the gap in the absence of air thereby preventing expansion and corresponding cavitation of the water in the gap.

In the embodiment of FIG. 1, hydrofoil blade support 10 includes a plurality of adjacent and alternating pairs of first hydrofoil blades 12 and second hydrofoil blades 30. Each hydrofoil blade is depicted as including a front surface extending downward from each respective leading edge at an acute angle relative to each respective forming medium bearing surface. Each hydrofoil blade is also depicted as including a water directing surface extending downward from each respective trailing edge. Each forming medium bearing surface lies in the first plane depicted at 24, and each trailing edge lies in the second plane depicted at 26. In the embodiment of FIG. 1, as between adjacent blades, each of the water directing surfaces overlaps and is spaced from an adjacent front surface, and respective first and second planes are spaced in the range of about 0.05 millimeters to about 4 millimeters, to form said gap forming means between adjacent hydrofoil blades.

Preferably, hydrofoil blade support 10 includes a blade or blades having a trailing surface which diverges downwardly to a third crease line 48, and includes a boundary forming surface 50 lying in the second plane, identified at 26, and extending from the third crease line to the trailing edge of each blade which includes such structure. In other words, each respective boundary forming surface 50 is parallel to each forming medium bearing surface. In this embodiment, the distance 44 is measured between the forming medium bearing surface and the boundary forming surface 50 of each hydrofoil blade. By providing a boundary forming surface 50, an extended channel is formed between the forming medium and the hydrofoil blade along which water flows in the absence of air.

Figure 3:
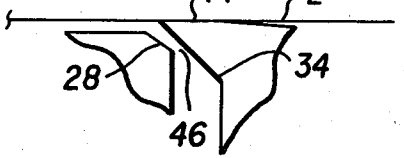
FIG. 3 is a partial view of a diagramatic representation of yet another embodiment of the present invention.
Figure 2:
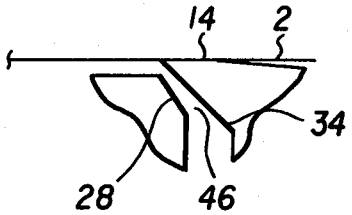
FIG. 2 is a partial view of a diagramatic representation of another embodiment of the present invention.

It will be noted that the overlapping of the water directing surface and the adjacent front surface define the channel 46 therebetween. To this end, preferably boundary forming surface 50 is terminated just ahead of the leading edge of the next hydrofoil blade and is followed by the downward inclined water directing surface which extends at an angle of 30° to 45° relative to the boundary forming surface 50. One or more of adjacent front surfaces and water directing surfaces can be parallel as depicted in FIG. 1. It is also within the teachings herein that one or more of such surfaces be slightly convergent towards the forming medium bearing surface as depicted in FIG. 2 or slightly convergent away from the forming medium bearing surface as depicted in FIG. 3. After providing a short parallel or almost parallel channel between the two hydrofoil blades, the trailing face of the blade abruptly changes its angle to 90° relative to the boundary forming surface 50, and the white water is flung into the atmosphere. At this point, the change in pressure is much smaller than that at the point where conventional hydrofoil blades discharge their white water into the atmosphere. Thus, the white water is removed from the underside of the forming medium as a continuous and uniformly thick column of water without an abrupt change in pressure at the face of the forming medium.

Figure 4:
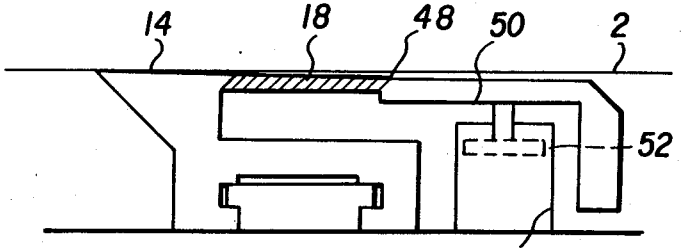
FIG. 4 is a diagramatic representation of a further embodiment of the present invention.

In the embodiment of FIG. 1, the height of the gap between the forming medium and the boundary forming surface 50 of the hydrofoil blade controls the amount of its dewatering. Therefore, making the size of this gap controllable is desirable so that the amount of dewatering at every point on the forming medium can be controlled and regulated. The present invention includes features directed to such a variable drainage rate hydrofoil blade. For example, in the embodiment of FIG. 4, which depicts a hydrofoil blade having a configuration similar to that of FIG. 1, reference characters corresponding to those of FIG. 1 are used for similar structure. In FIG. 4, the trailing surface 18 is pivotally connected to the forming medium bearing surface 14, and to the boundary forming surface 50 at the third crease line 48. For example, FIG. 4 depicts trailing surface 18 as a flexible member extending from surface 14 to surface 50. It will be apparent to those skilled in the art that other types of pivotal connections can be provided. Means are provided coupled to the boundary forming surface 50 for varying the distance between surface 50 and the first plane, in which lies the forming medium bearing surface 14, so that such distance can be controlled as desired. For example, by way of example only, FIG. 4 schematically depicts a piston 52 and cylinder 54 for hydraulically or pneumatically raising and lowering boundary forming surface 50. In operation, the raising of piston 52 decreases the degree by which surface 50 diverges from surface 14 and decreases the vertical distance between the first plane identified at 24 and the second plane identified at 26 to decrease the size of the gap. Lowering of piston 52 increases the degree by which surface 50 diverges from surface 14 and increases the vertical distance between the planes identified at 24 and 26 to increase the size of the gap.

Illustrative of one embodiment, the forming medium bearing surface 14 is about one centimeter in length, the trailing surface 18 is about 3 to 15 centimeters in length, and the boundary forming surface 50 is about 1 to 15 centimeters in length. The diverging angle of the trailing surface 18 is 0° to 5° as described in Wrist, U.S. Pat. No. 2,948,465.

By means of the present invention, a method is provided using hydrofoil blades for dewatering and forming a paper web on a paper machine forming medium by removing water from the paper web, and the fiber suspension carried thereby, by suction created by the hydrofoil blades and including the critical steps of (1) forming a single phase fluid in a gap between adjacent hydrofoil blades and the forming medium, and (2) extending the gap a sufficient distance in the machine direction to prevent expansion and corresponding cavitation of the single phase fluid in the gap. In this manner, instead of emptying the white water removed by the vacuum created by the inclined surface of the hydrofoil blade directly into the atmosphere, such water is carried along the underside of the forming medium in an air free gap between the underside of the forming medium and adjacent hydrofoil blades. As the vacuum decays in this gap, the decay is gradual rather than abrupt, and therefore is not unstable. It is gradual because the partially-formed web and stock over the forming medium represent a considerable resistance to the pressure differential between this gap and the atmosphere above the stock.

It should be noted that in the embodiment of FIG. 1 it is the creation of the fixed horizontal gap following the vacuum-inducing downward sloping face 18 of the hydrofoil blade which literally forces the blade to dewater the same amount of water from the suspension from point to point across the entire length of the blade. By providing a gap which is sufficiently narrow and cannot cavitate back from its exit point to the atmosphere, the gap will be fully filled with fluid pulled in from above through the forming medium.

An important aspect of the present invention is to identify the magnitude of distance 44 to assure that the gap between the underside of the forming medium and adjacent hydrofoil blades is filled with water in the absence of air; that is, to cause a single phase fluid to be carried along the underside of the forming medium in the gap. Considering that the typical hydrofoil blade is designed to have a trailing surface diverging at an angle of 0° to 5° as described in U.S. Pat. No. 2,948,465, the critical dimension in defining the distance 44 is the length of the trailing surface 18. In order to assure that the gap is completely filled with a single phase fluid, i.e., is filled with water in the absence of air, the height 44 for the blades being used can be ascertained by calculating the difference between the stock thickness at the slice opening and at the end of the forming zone, using the equation:

$$T = \frac{W}{C \times R \times J}$$

wherein T is the stock thickness, W is the basis weight of the finished sheet, C is the stock consistency expressed as a fraction, R is the overall machine retention downstream from the point under consideration, and J is the jet-to-forming medium speed ratio.

The use of this equation will now be demonstrated, by way of example only, in connection with a paper making machine producing news-print-type paper. The above equation is first used to determine the stock thickness $T_1$ at the slice opening. Assuming that the basis weight $W_1$ is 50 g.s.m., the consistency $C_1$ is 0.5%, the retention $R_1$ is 60% and the jet-to-forming medium speed ratio $J_1$ is 0.95, then the thickness of the stock at the slice opening is:

$$T_1 = \frac{W_1}{C_1 \times R_1 \times J_1} = \frac{.0050}{.005 \times .6 \times .95} = 1.75 \text{ cm}$$

The stock thickness $T_2$ at the end of the web forming zone can be calculated in a like manner. Assuming that the basis weight $W_2$ is still 50 g.s.m., the consistency $C_2$ has increased to 2.5%, the overall machine retention $R_2$ of the balance of the paper making machine is 90%, and the jet-to-forming medium speed ratio $J_2$ has increased to 1.0, then the thickness of the stock at the end of the web forming zone is:

$$T_2 = \frac{W_2}{C_2 \times R_2 \times J_2} = \frac{.0050}{.025 \times .9 \times 1} = .22 \text{ cm}$$

The thickness of water Q removed from the forming section is equal to the difference between the stock thickness at the slice opening and the stock thickness at the end of the web forming zone, or $$Q = T_1 - T_2 = 1.54 \text{ cm}$$

Assuming that in the past twenty conventional 1° and 2° hydrofoil blades have been required to obtain this result, then the gap 44 should be:

$$\frac{1.54 \text{ cm}}{20} = .08 \text{ cm}$$

Further, assuming that it is desired to use twenty five 1° blades to compensate for wear of surface 14 and to accomplish similar dewatering, then in order to assure the existence of a 0.08 cm gap 44, the length L of the trailing surface is $$L = 0.08 \tan 1° = 4.6 \text{ cm}$$

Since the basis weight of the finished sheet (W), stock consistency (C), overall machine retention (R) and jet-to-forming medium speed ratio (J) are identifiable in a known manner for any paper machine at the slice opening and at the end of the web forming zone, the above equations can be used to identify the dimension of gap 44 and the length L of the trailing surface for any paper making application.

Dewatering using hydrofoil blades in that the dewatering is carried out entirely in a confined and controllable gap, and hence dewatering will be highly uniform along the cross machine direction of each blade. Furthermore, the pressure pulse causing a loss of fines and filler particles will be substantially eliminated, and the so-called "two-sidedness" of paper as well as the intensity of the well-known "wire mark" will be substantially decreased. Finally, the repetitive ridges formed by formation showers will not be subject to destructive pulses, and will carry them much further down the forming medium than is presently the case.

Figure 5:
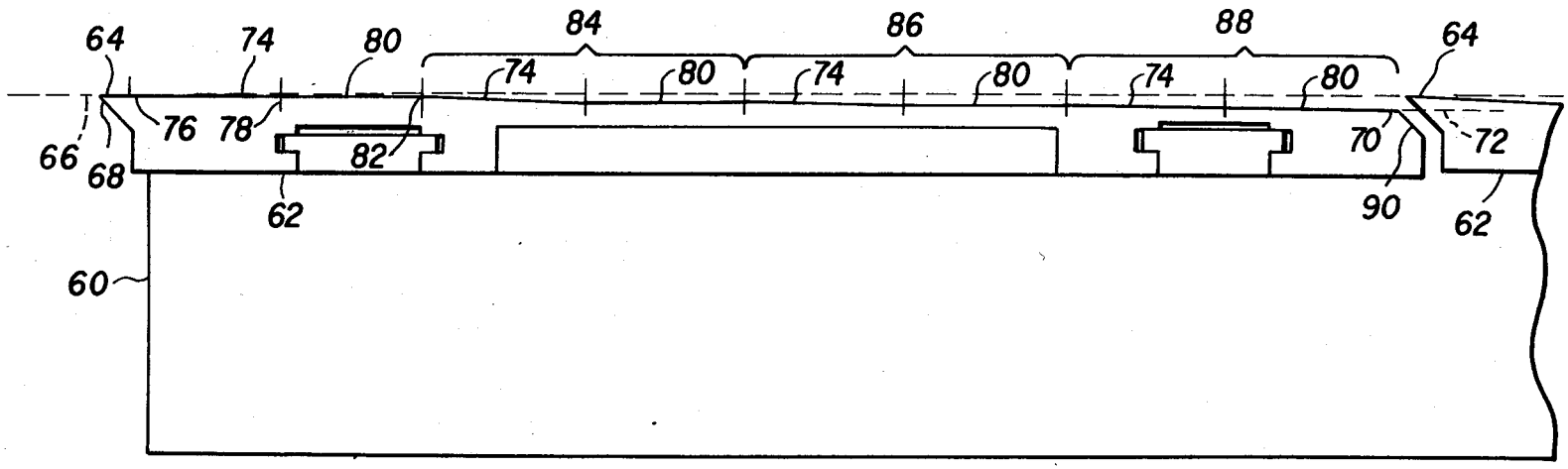
FIG. 5 is a diagramatic representation of a further embodiment of the present invention; and, FIG. 6 is a fragmentary view of FIG. 5 having dimensions which have been exaggerated for emphasis.
Figure 6:
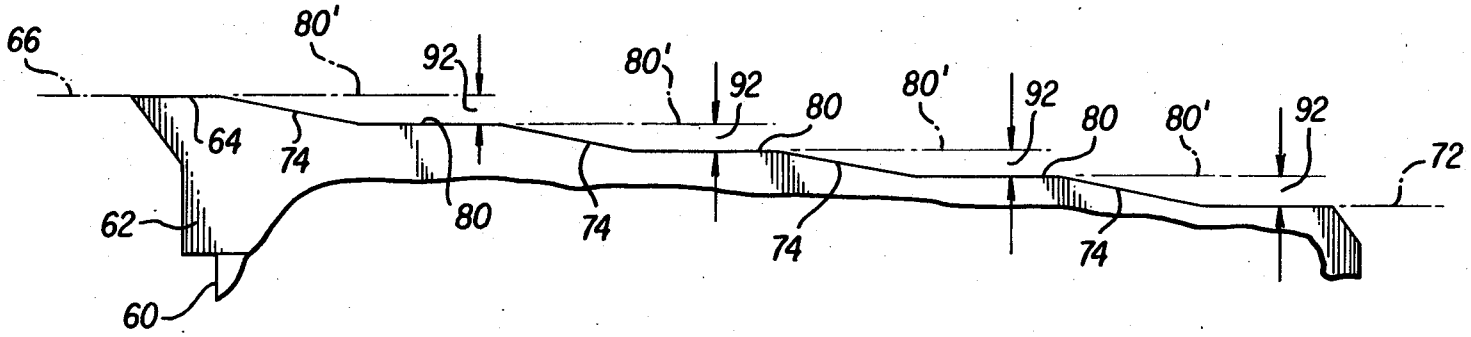

Another embodiment of the present invention is depicted in FIG. 5 which depicts a hydrofoil blade support 60 comprising a plurality of spaced hydrofoil blades 62 which comprise a forming medium bearing surface 64 lying in a first plane identified schematically at 66 and having a leading edge 68, and a trailing edge 70 lying in a second plane, identified schematically at 72, parallel to the first plane. A first trailing surface 74 diverges downward relative to the forming medium bearing surface 64 from a first crease line 76 to a second crease line 78. A first boundary forming surface 80 extends from the second crease line 78 to a third crease line 82, and at least one other pair of trailing and boundary forming surfaces extend in tandem between the third crease line 82 and the trailing edge 70. For example, blade 62 includes a plurality of pairs 84, 86, 88 of trailing surfaces 74 and boundary forming surfaces 80 which extend in tandem, one pair following the next in the machine direction. As depicted in FIG. 6, each of the boundary forming surfaces lie in planes, schematically depicted at 80' in FIG. 6, parallel to the forming medium bearing surface 64, consecutive of planes 66, 80', 72 being spaced from each other in the range of about 0.05 millimeters to about 4 millimeters. Although not necessary in this embodiment, if it is desired to prolong the length of the gap between adjacent hydrofoil blades a water directing surface 90 is provided as in the other embodiments herein extending downward from the trailing edge 70. When using the blades 62, the height of the gap 92 between consecutive of planes 66, 80', 72 corresponds to dimension 44 of FIG. 1, and is measured in the same manner. It should be noted that the equations set forth herein are equally applicable to the embodiment of FIGS. 5 and 6. In particular, although the equations demonstrate how to identify the magnitude of gap 44, they are equally applicable in identifying the magnitude of each gap 92, the critical dimension in defining the height of each gap 92 being the length L of each respective trailing surface 74. In other words "L" can be equated to the length of trailing surface 18 in using the equations to identify the magnitude of gap 44 in FIG. 1 or to the length of each trailing surface 74 in FIGS. 5 and 6 in using the equations to separately identify the magnitude of each gap 92. Without being limited to any theory of operation, it is believed that the water removed at each trailing surface 74 in the embodiment of FIGS. 5 and 6 travels along each respective gap 92. At the end of each respective gap 92 such moving water continues to travel but under the water being removed by the next trailing surface 74. In other words, the water removed at each trailing surface 74 travels through the gap 92 associated with such trailing surface and is then carried under the water removed by each succeeding trailing surface 74, all of such water being removed at the end of the hydrofoil blade.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A hydrofoil blade for use in a paper making machine of the type wherein hydrofoil blades are positioned beneath a forming medium and extended in the cross machine direction relative to said forming medium for draining water through said forming-medium while a paper web is being formed on said forming medium and for forming said paper web, said hydrofoil blade comprising a forming medium bearing surface lying in a first plane and having a leading edge, and a trailing edge lying in a second plane parallel to said first plane, a first trailing surface diverging downward relative to said forming medium bearing surface from a first crease line to a second crease line, a first boundary forming surface extending from said second crease line to a third crease line in a third plane which is located intermediate of and parallel to said first plane and said second plane, and at least one other pair of trailing and boundary forming surfaces extending in tandem between said third crease line and said trailing edge, each additional of said boundary forming surfaces lying in a plane which is located intermediate of and parallel to said second and third planes, the last of said boundary forming surfaces lying in said second plane and extending to said trailing edge, consecutive of said planes being spaced from each other in the range of about 0.05 millimeters to about 4 millimeters.

2. The hydrofoil blade of claim 1 including a water directing surface extending downward from said trailing edge.

3. A hydrofoil blade support for use in a paper making machine of the type wherein hydrofoil blades are positioned beneath a forming medium and extended in the cross machine direction relative to said forming medium for draining water through said forming-medium while a paper web is being formed on said forming medium and for forming said paper web, said hydrofoil blade support comprising a plurality of spaced hydrofoil blades which each comprise a forming medium bearing surface lying in a first plane and having a leading edge, and a trailing edge lying in a second plane parallel to said first plane, a first trailing surface diverging downward relative to said forming medium bearing surface from a first crease line to a second crease line, a first boundary forming surface extending from said second crease line to a third crease line in a third plane which is located intermediate of and parallel to said first plane and said second plane, and at least one other pair of trailing and boundary forming surfaces extending in tandem between said third crease line and said trailing edge, each additional of said boundary forming surfaces lying in a plane which is located intermediate of and parallel to said second and third planes, the last of said boundary forming surfaces lying in said second plane and extending to said trailing edge, consecutive of said planes being spaced from each other in the range of about 0.05 millimeters to about 4 millimeters.

4. The hydrofoil blade support of claim 3 wherein said hydrofoil blades include at least a first and second adjacent hydrofoil blade, said second hydrofoil blade being adjacent to and downstream of said first hydrofoil blade and having a front surface (a) which extends downward in a downstream direction from said leading edge of said second hydrofoil blade at an acute angle relative to said forming medium bearing surface of said second hydrofoil blade, and, (b) which is spaced from and superposed relative to a water directing surface of said first hydrofoil blade which extends downward in a downstream direction from said trailing edge of said first hydrofoil blade at an angle relative to said second plane of said first hydrofoil blade, to form means in the form of a gap between said adjacent hydrofoil blades, when said hydrofoil support is mounted on said paper making machine, for removing water from said paper web by suction created by said first hydrofoil blade during the paper making operation and completely filling said gap with said water in the absence of air thereby preventing expansion and corresponding cavitation of said water in said gap.

5. The hydrofoil blade of claim 4 including at least one other pair of said first and second hydrofoil blades, each of said first and second hydrofoil blades of said at least one other pair including one of said water directing surfaces and one of said front surfaces, and adjacent of said water directing surfaces and front surfaces forming said water removal and filling means.

6. The hydrofoil blade support of claim 3 wherein at least one of said trailing surfaces is pivotally connected to its adjacent forming medium bearing surface and to its adjacent boundary forming surface, and including means coupled to said adjacent boundary forming surface for varying the distance between said adjacent boundary forming surface and said first plane.

7. The hydrofoil blade support of claim 4 wherein said front surface and said water directing surface are parallel.

8. The hydrofoil blade support of claim 4 wherein said front surface and said water directing surface converge towards said forming medium bearing surface.

9. The hydrofoil blade support of claim 4 wherein said front surface and said water directing surface converge away from said forming medium bearing surface.

10. The hydrofoil blade support of claim 5 wherein said front surfaces and said water directing surfaces are parallel.

11. The hydrofoil blade support of claim 5 wherein said front surfaces and said water directing surfaces converge towards said forming medium bearing surfaces.

12. The hydrofoil blade support of claim 5 wherein said front surfaces and said water directing surfaces converge away from said forming medium bearing surfaces.

* * * * *